US005135223A

United States Patent [19]

You

[11] Patent Number: 5,135,223

[45] Date of Patent: Aug. 4, 1992

[54] SPORTS RACKET FRAME

[76] Inventor: Chin-San You, No. 3, Lane 1029, Feng-Shyn Road, Feng Yuan City, Taichung Hsien, Taiwan

[21] Appl. No.: 690,713

[22] Filed: Apr. 24, 1991

[51] Int. Cl.[5] ..... A63B 49/06

[52] U.S. Cl. ..... 273/73 J; 273/81 R; 273/73 G

[58] Field of Search ..... 273/73 J, 73 F, 73 K, 273/75, 81 R, 81 B, 73 R, 73 G

[56] References Cited

U.S. PATENT DOCUMENTS

| | | | |
|---|---|---|---|
| 2,257,326 | 9/1941 | Blum | 273/73 J |
| 4,203,596 | 5/1980 | Nagamoto | 273/73 J |
| 4,278,251 | 7/1981 | Lafourcade | 273/73 J X |
| 4,441,713 | 4/1984 | Van Dyck | 273/73 J |
| 4,627,635 | 12/1986 | Koleda | 273/73 J X |
| 4,660,832 | 4/1987 | Shomo | 273/73 J |
| 4,671,511 | 6/1987 | Trysinsky | 273/73 J |
| 4,765,856 | 8/1988 | Doubt | 273/73 J X |
| 4,907,810 | 3/1990 | Whiteford | 273/73 J |
| 5,039,096 | 8/1991 | Chen | 273/73 J X |
| 5,042,805 | 8/1991 | Nakai | 273/73 J X |

FOREIGN PATENT DOCUMENTS

| | | | |
|---|---|---|---|
| 323770 | 1/1930 | United Kingdom | 273/73 J |
| 442975 | 2/1936 | United Kingdom | 273/73 J |
| 2218642 | 11/1989 | United Kingdom | 273/73 J |

*Primary Examiner*—George J. Marlo
*Assistant Examiner*—William E. Stoll
*Attorney, Agent, or Firm*—Fleit, Jacobson, Cohn, Price, Holman & Stern

[57] ABSTRACT

A sports racket frame comprises an outer shell made of a fiber-reinforced composite. Located at a predetermined area of the outer shell encasing the handle portion are slits in the shell and a plurality of strength-reinforcing and shock-absorbing inlay pieces which reduce effectively the shock wave originating from the ball-hitting surface to a minimum and to give the racket frame an added elasticity and rigidity.

11 Claims, 3 Drawing Sheets

SPORTS RACKET FRAME

BACKGROUND OF THE INVENTION

The present invention relates to a tennis racket, a squash racket, and a badminton racket, and more particularly to a sports racket made of a fiber reinforced composite material capable of minimizing the shock exerted on the hand of a player using the sports racket.

Generally speaking, a sports racket of conventional type made of a fiber reinforced composite material comprises an outer shell of a fiber reinforced plastic. In the process of making such a sports racket as mentioned above, the outer shell is formed by means of placing intertwined fabric containing long fibers and thermosetting resin into a mold. As a result, the head portion and the handle portion of the racket are similar in terms of their cross-sectional structures. In view of a shock-transmitting system, the structural uniformity of the head portion and the handle portion, which are made into a unitized body, is responsible for an easy transmission of shock with a minimum of obstruction. It is readily apparent that the shock generated by an impact of a ball on the ball-hitting surface of the racket described above is subject to transmission easily from the head portion to the handle portion and then on to the hand which holds the racket.

In order to find a solution to the problem described above, a number of inventions have been developed and disclosed. For example, the inventor of Taiwan Patent No. 78201997 discloses a sports racket having means to prevent the shock of striking a ball from being transmitted to the handle. However, the constructional complexity of this invention makes it impractical from the standpoint of manufacture thereof and also results in a great deal of compromise of shock-absorbing effect thereof.

A sports racket having a shock-absorbing means in the form of elastic sponge is suggested by the inventor of Taiwan Patent No. 75210508. This disclosure emphasizes the use of spongy pieces of a high elasticity, which are inserted into the strings forming the ball-hitting surface so as to absorb the shock generated on the strings. However, the arrangement as such does not serve to mitigate the shock exerted on the racket frame.

The Taiwan Patent No. 78210299 discloses a sports racket having a frame structure capable of obstructing the transmission of shock, in which a plurality of grooves are constructed on the handle portion of the racket. Each of the grooves is covered with a shock-absorbing strap, which serves to hinder the shock wave. In fact, the transmission of the shock wave from the head frame to the grip portion can not be effectively averted by means of a structure such design as disclosed in this invention.

Additionally, the Taiwan Patent No. 78211558 discloses an improved structure for use in absorbing the shock exerted on a sports racket, which is characterized in that the edge of inner circumference of the head frame comprises a plurality of grooves, which are made into a unitized body of the head frame. A shock-absorbing rib bar is embedded in each of the grooves. It must be pointed out that the shock generated on the strings traversing the shock-absorbing rib bar can be effectively absorbed. However, the shock generated on those strings which do not traverse the shock-absorbing rib bar is not effectively mitigated. In addition, the inventor of this disclosure ignores the fact that the structural design as suggested results in a technical difficulty of stretching the strings across the head frame of the racket.

As far as a sports racket having an outer shell of fiber-reinforced plastic material is concerned, an effective method used to obstruct the transmission of the shock wave from the head frame to the handle portion of the racket has not been introduced so far.

SUMMARY OF THE INVENTION

It is, therefore, the primary objective of the present invention to provide a sports racket with a frame having a multi-layered structure made of fiber-reinforced composite material as the outer shell thereof, which is capable of effectively mitigating the shock exerted on the hand of a player.

It is another objective of the present invention to provide a sports racket with a frame of fiber-reinforced plastic material, which is capable of effectively obstructing the shock wave transmission from the ball-hitting surface of the racket to the hand of a player using the racket.

It is still another object of the present invention to provide a sports racket with a frame capable of absorbing the shock, which is generated on the ball-hitting surface upon being impacted by a ball and is subsequently transmitted to the hand of a player.

It is still another objective of the present invention to provide a sports racket with a frame whose rigidity and elasticity can be adjusted, in accordance with requirements of players, during the process of manufacture thereof.

In keeping with the principles of the present invention, the primary objectives of the present invention are accomplished by a sports racket having a frame, which comprises a head portion defining the ball-hitting surface and a shaft connected with the head portion at one end thereof. The frame further comprises an outer shell, which is formed by a plurality of long cloths of fibrous fabric pre-soaked in a thermosetting resin and which is characterized in that it includes thereon a certain number of slits located on an area of the handle portion away from one end of the head portion at a predetermined distance. The fibrous number of all fiber cut by the slits must be in a predetermined proportion to the total fiber and number of the area of outer shell wherein the slits are constructed. The slits serve to obstruct effectively the shock wave transmission from the head portion to the handle. As a result, the shock exerted on the hand of a player is greatly lessened.

The number of fibers cut by the slits is proportional to the total fiber number of the handle portion of the outer shell. Therefore, the ratio between the number of fibers cut by the slits and the total fiber number of the handle portion of the outer shell can be adjusted in accordance with a specific requirement. For example, if a great rigidity and a greater striking force of a sports racket are called for, the ratio can be reduced accordingly. On the contrary, if a sports racket is intended for use by a beginner, a girl, or a child, the ratio can be increased. Generally speaking, the ratio between sum of fibers cut by the slits and sum of fibers of the handle portion of outer shell is 5%–95%.

The sports racket frame embodied in the present invention is characterized by a covering layer encasing the area of outer shell where the slits are constructed. The covering layer of a polymeric material or a fiber-reinforced plastic material serves to absorb the residue of shock waves.

The sports racket frame embodied in the present invention is further characterized by a certain number of inlays embedded in the area wherein the slits are constructed. The inlays, which are made of metal, wood, elastic plastic, fiber-reinforced plastic, etc., are used to absorb the shock and to reinforce the strength of the area wherein they are lodged.

The sports racket frame embodied in the present invention is still further characterized by a certain number of receiving slots constructed in the area of outer shell wherein the fibrous cleavages are arranged. The receiving slots are used to accommodate the inlays securely in place.

DETAILED DESCRIPTION OF THE PREFERRED EMBODIMENTS

Figure 1:
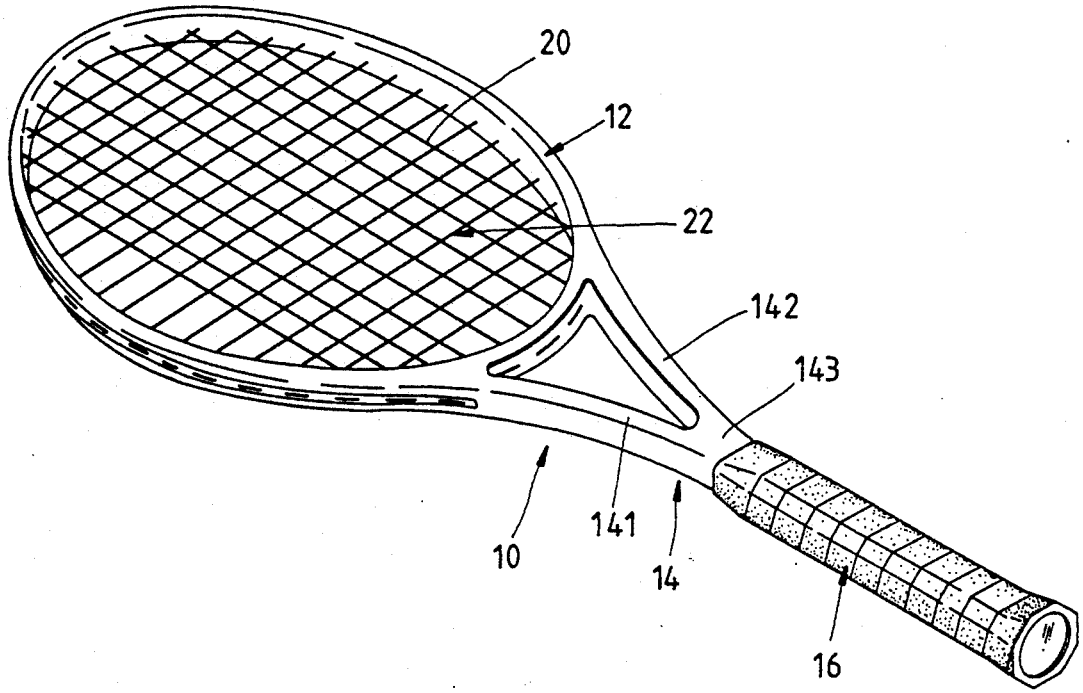
FIG. 1 is a three-dimensional view of a sports racket frame embodied in the present invention.

Referring to FIG. 1, the sports racket frame 10 embodied in the present invention is shown comprising an oval head portion 12, a throat portion 14 including two branch arms 141 and 142 and a throat bottom 143. The handle portion 16 is coupled with the throat bottom 143.

The racket frame 10 embodied in the present invention further comprises an outer shell 30, which is formed by heating and molding a plurality of the preoriented and intertwined cloths of carbonaceous fiber pre-soaked in the epoxy resin. The outer shell 30 encases a foam core 32.

Figure 2:
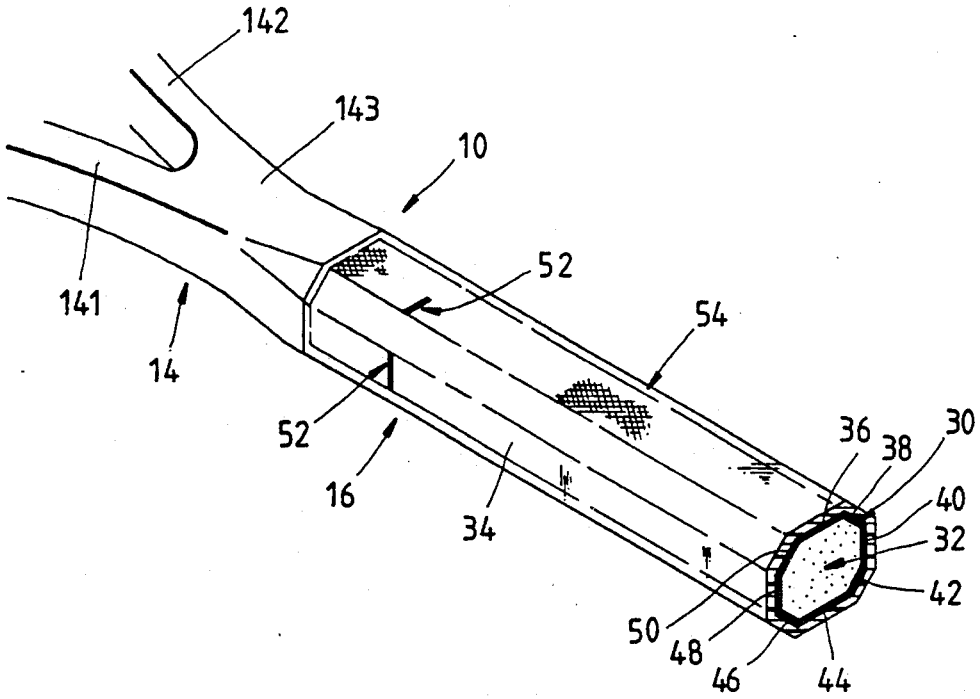
FIG. 2 is a three-dimensional view of a portion of the first preferred embodiment of the present invention.

As shown in FIG. 2 illustrating the first embodiment of the present invention, the outer shell 30 includes a part 34 covering one end of the handle portion 16 which is adjacent the throat portion 14. The concave area 34 is octagonal in cross section thereof and is therefore composed of eight rectangular surfaces 36, 38, 40, 42, 44, 46, 48, and 50. Located on each of first, third, fifth, and seventh rectangular surfaces 36, 40, 44, and 48 is a fibrous slit 52 perpendicular to the axial center of the throat portion 14. These four slits 52 so constructed are not situated on the same plane. As far as the first embodiment of the present invention is concerned, the sum of fibers cut by the slits 52 is about 50% of the total fiber number of the portion 34. The shock wave, which is generated on the ball-hitting surface 22 and is subsequently transmitted along the head portion 12 and the throat portion 14, is effectively obstructed and mitigated in the concave area 34 before reaching the handle portion 16. As a result, the shock exerting on the hand holding the handle portion 16 is effectively minimized. In addition, the sports racket frame 10 of the first embodiment of the present invention comprises a covering layer 54, which is made of polymer and is used to encase the concave portion 34 so as to absorb the residual shock wave and to reinforce the strength of the portion 34 which may be concave.

Figure 3:
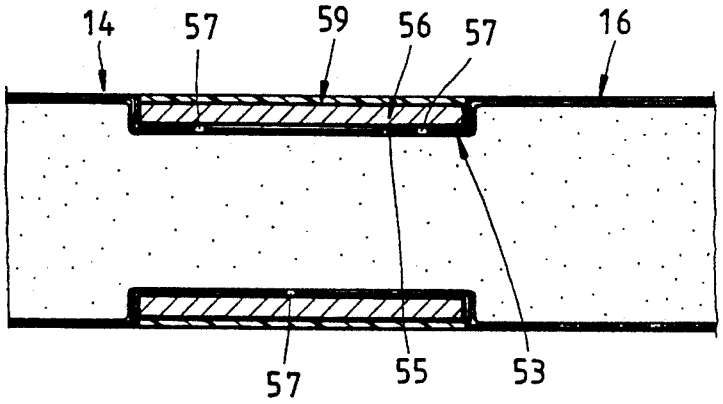
FIG. 3 is a cross-sectional view of the second preferred embodiment of the present invention.
Figure 4:
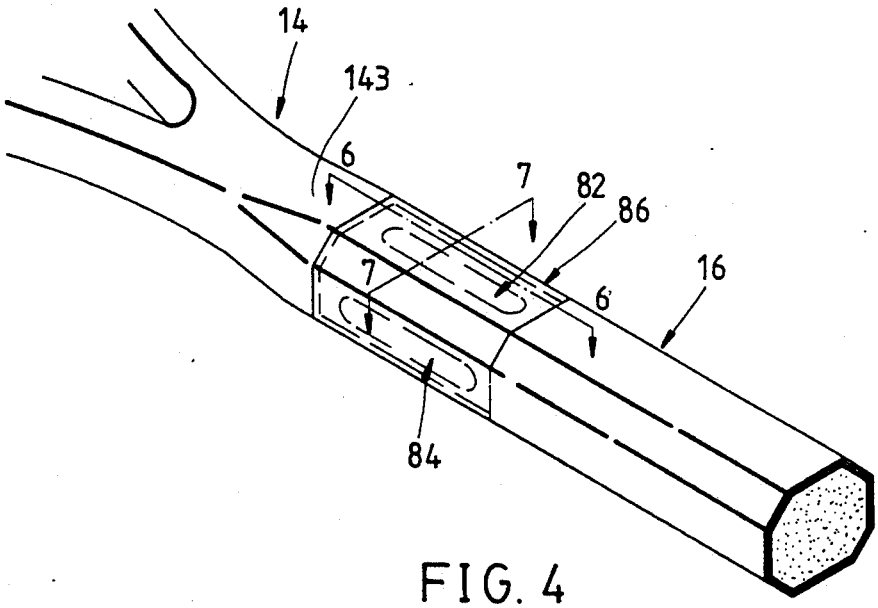
FIG. 4 is a three-dimensional view of a portion of the third preferred embodiment of the present invention.
Figure 5:
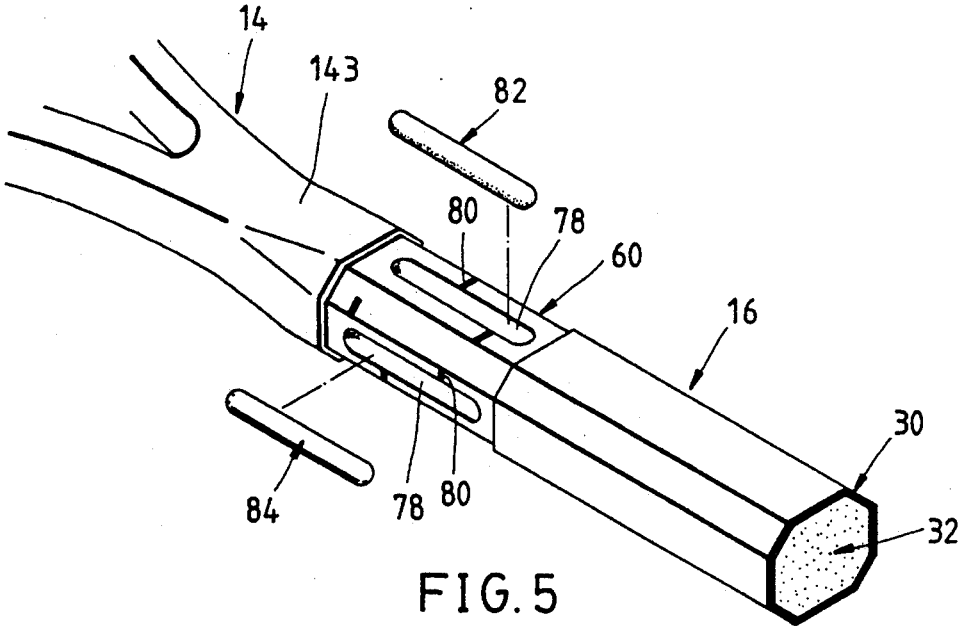
FIG. 5 is an exploded view of a portion of the third preferred embodiment of the present invention.
Figure 6:
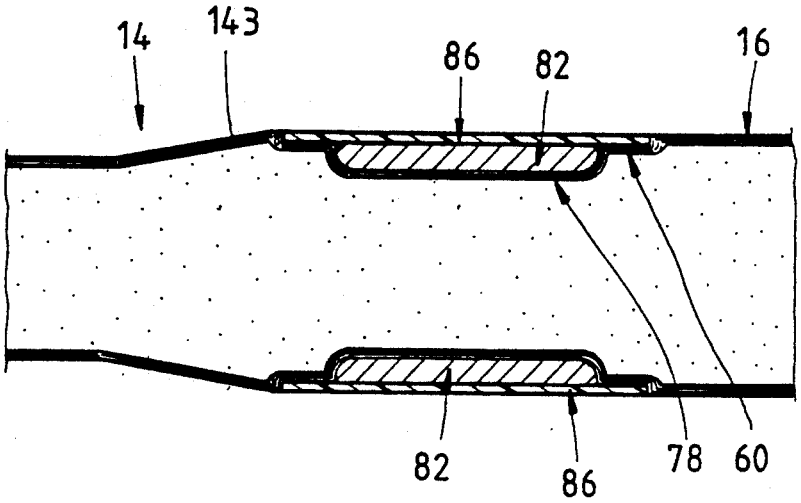
FIG. 6 is a cut-away view of a portion taken along line 6—6 as shown in FIG. 4.
Figure 7:
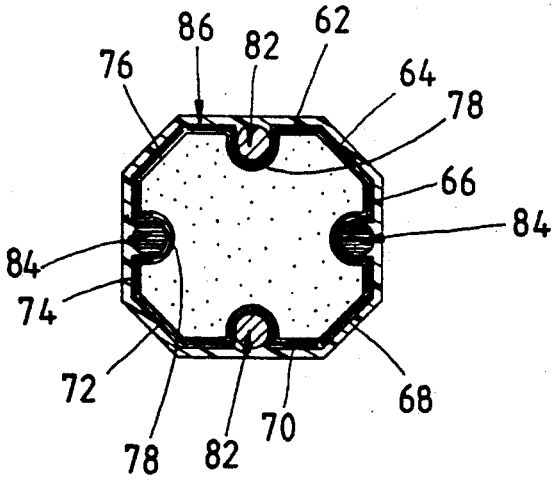
FIG. 7 is a cut-away view of a portion taken along line 7—7 as shown in FIG. 4.

Now referring to FIG. 3, the second preferred embodiment of the present invention is shown comprising an annular recess 53 with eight rectangular surfaces 55 therearound. Located on each of the first, the third, the fifth and the seventh rectangular surfaces is a slit 57, wherein an inlay rod 56 is lodged. The inlay rod 56 is encased with a covering layer 59 in order to give the annular recess 53 an added rigidity. The inlay rod 56 may be made of a fiber-reinforced plastic material, a metal, a wood, an elastic plastic, or a ceramic material.

The third preferred embodiment of the present invention is illustrated in FIGS. 4–7. An annular recess 60 is constructed in the portion of outer shell 30 located at the junction between the throat bottom 143 and the handle portion 16. The recess 60 has an octagonal cross section having eight adjacent rectangular surfaces 62, 64, 66, 68, 70, 72, 74, and 76. Located in each of the first, the third, the fifth, and the seventh rectangular surfaces 62, 66, 70, and 74 is a receiving slot 78 of a predetermined depth parallel to the axial center of the throat portion 14. In addition, each of the rectangular surfaces 62, 66, 70, and 74 comprises therein a slit 80 of a predetermined length. It must be noted that slits 80 of rectangular surfaces 62, 66, 70, and 74 are of different lengths and are arranged randomly on different planes. The sum of fiber cut by the slits 80 is preferably about 40% of the total fiber number of the annular recess 60. In addition, a shock-absorbing rod 82 made of an elastic plastic is embedded in each receiving slot 78 of the first and the fifth rectangular surfaces 62 and 70. A reinforced rod 84 made of a fiber-reinforced plastic is lodged in each receiving slot 78 of the third and the seventh rectangular surfaces 66 and 74. Finally, the outer shell 30, which has been so constructed as described above, is placed in an injection mold wherein a composite material containing short fibers and epoxy resin is used to form covering layers 86 encasing the recesses 60.

As a result, about 40% of fibers forming the outer shell 30 located at the front end portion of the handle portion 16 have been cut so as to obstruct effectively the transmission of the shock wave originating from the ball-hitting surface 22 upon an impact by a ball. The residual shock wave is absorbed by shock-absorbing rods 82 and covering layers 86. Therefore, the shock wave exerting on the hand of a player is effectively reduced to a minimum. Furthermore, the rigidity of the sports racket frame 10 is further enhanced by means of two reinforced rods 84 embedded in circular recesses 60 thereof so as to increase the striking force of the racket against the ball.

What I claim is:

1. A sports racket frame having a head portion, a handle portion and a throat portion connecting the head portion to the handle portion, the frame including a multi-ply outer shell of resin-impregnated fibrous fabric with a part of said shell encasing one end of the handle portion which is adjacent the throat portion, said part of the shell being severed by a plurality of slits cutting through fibers of the shell for inhibiting the transmission of shock waves from the head portion of the frame to the handle portion of the frame, the number of fibers cut by the slits comprising from 5% to 95% of the total number of fibers in said part of the shell.

2. A sports racket frame according to claim 1, wherein the slits are oriented substantially transversely to a longitudinal axis of said handle portion.

3. A sports racket frame according to claim 1, wherein said slits are disposed in different transverse planes.

4. A sports racket frame according to claim 1, wherein said part of the shell includes an annular recess containing the slits.

5. A sports racket frame according to claim 4, wherein said part of the shell is encased by an elastic covering layer.

6. A sports racket frame according to claim 5, wherein the covering layer comprises a polymeric material.

7. A sports racket frame according to claim 1, wherein said part of the frame is encased by an elastic covering layer and a plurality of shock-absorbing inlay pieces are disposed between said part of the shell and said covering layer.

8. A sports racket frame according to claim 7, wherein the inlay pieces are received in axially extending slots formed in said part of the shell.

9. A sports racket frame according to claim 7, wherein the inlay pieces comprise a plastic material.

10. A sports racket frame according to claim 7, wherein the inlay pieces comprise a metal material.

11. A sports racket frame according to claim 7, wherein the inlay pieces comprise a wood material.

* * * * *